US005356078A

United States Patent [19]

Bischoff

[11] Patent Number: 5,356,078

[45] Date of Patent: Oct. 18, 1994

[54] ADJUSTABLE HAND-SHOWER ASSEMBLY

[75] Inventor: Bernd Bischoff, Iserlohn, Fed. Rep. of Germany

[73] Assignee: Friedrich Grohe Aktiengesellschaft, Hemer, Fed. Rep. of Germany

[21] Appl. No.: 125,501

[22] Filed: Sep. 22, 1993

Related U.S. Application Data

[63] Continuation-in-part of Ser. No. 881,687, May 12, 1992, abandoned.

[51] Int. Cl.[5] ..... B05B 1/16

[52] U.S. Cl. ..... 239/447

[58] Field of Search ..... 239/443–447, 239/600; 285/305, 309, 321

[56] References Cited

U.S. PATENT DOCUMENTS

| | | | |
|---|---|---|---|
| 3,998,390 | 12/1976 | Peterson et al. | 239/443 X |
| 4,081,135 | 3/1978 | Tomaro | 239/447 X |
| 4,165,837 | 8/1979 | Rundzaitis | 239/443 X |
| 4,561,593 | 12/1985 | Cammack et al. | 239/443 X |
| 4,722,559 | 2/1988 | Bongartz | 239/600 X |
| 4,838,486 | 6/1989 | Finkbeiner | 239/447 X |
| 4,880,164 | 11/1989 | Noordermeer | 239/600 X |
| 5,087,361 | 2/1992 | Gaudin et al. | 239/600 X |

FOREIGN PATENT DOCUMENTS

| | | | |
|---|---|---|---|
| 348359 | 12/1989 | European Pat. Off. | 239/447 |
| 2155075 | 5/1973 | Fed. Rep. of Germany . | |
| 3300469 | 3/1984 | Fed. Rep. of Germany . | |
| 3509602 | 9/1986 | Fed. Rep. of Germany | 239/436 |
| WO8404059 | 10/1984 | PCT Int'l Appl. . | |

*Primary Examiner*—Andres Kashnikow
*Assistant Examiner*—Kevin P. Weldon
*Attorney, Agent, or Firm*—Herbert Dubno; Andrew Wilford

[57] ABSTRACT

An adjustable shower assembly has a housing provided with a water-supply tube defining a seat, a core element fixed in the seat and having a stem extending from the seat along an axis and having an outer end formed with a noncircular boss generally centered on the axis, and a diverter formed with a central bore fitted over the stem and provided with at least two throughgoing passages. The diverter is at least limitedly rotatable on the stem. An end plate is formed with at least two sets of nozzles associated with the respective passages in respective angular positions of the diverter on the core element and formations on the end plate and diverter axially and rotationally fix the end plate on the diverter. A washer having a central hole complementary to and interfitting with the boss of the stem bears axially backward on the diverter and a screw threaded axially into the stem and bearing axially backward on the washer retains the diverter and end plate axially on the core element.

7 Claims, 2 Drawing Sheets

ADJUSTABLE HAND-SHOWER ASSEMBLY

CROSS-REFERENCE TO RELATED APPLICATION

This application is a continuation-in-part of copending patent application Ser. No. 07/881,687 filed 12 May 1992 now abandoned with a claim to the priority of German patent application P 41 16 927.1 filed 24 May 1991.

FIELD OF THE INVENTION

The present invention relates to a shower head. More particularly this invention concerns a shower head usable in a hand shower.

BACKGROUND OF THE INVENTION

A standard hand shower has a handle-forming housing whose rear end is connected to a water-supply hose and whose front end is provided with a shower head which can be rotated to switch the device between different spray modes. The shower head is a relatively complex subassembly that is mounted in the front housing end. While on the one hand it must be fairly complex to provide different spray modes, on the other hand it must be ruggedly and simply built so that it can have a long service life and be produced at low cost.

OBJECTS OF THE INVENTION

It is therefore an object of the present invention to provide an improved hand-shower head.

Another object is the provision of such an improved hand-shower head which is of simple but rugged construction.

SUMMARY OF THE INVENTION

An adjustable shower assembly has according to the invention a housing provided with a water-supply tube defining a seat, a core element fixed in the seat and having a stem extending from the seat along an axis and having an outer end formed with a noncircular boss generally centered on the axis, and a diverter formed with a central bore fitted over the stem and provided with at least two throughgoing passages. The diverter is at least limitedly rotatable on the stem. An end plate is formed with at least two sets of nozzles associated with the respective passages in respective angular positions of the diverter on the core element and formations on the end plate and diverter axially and rotationally fix the end plate on the diverter. A washer having a central hole complementary to and interfitting with the boss of the stem bears axially backward on the diverter and a screw threaded axially into the stem and bearing axially backward on the washer retains the diverter and end plate axially on the core element.

The shower head itself is thus formed into two neat subassemblies that each are structurally coherent, making assembly of the device particularly simple. The screw or bolt is not subject to being unscrewed as the device is adjusted, and provides a very simple but solid mounting of the two subassemblies together.

According to further features of the invention the formations include an annular array of axially rearwardly projecting and radially deflectable snap tongues on the end plate and a radially outwardly projecting ridge on the diverter engages under the tongues. A snap ring engaged radially around the tongues retains same in place over the ridge of the diverter. Each tongue is formed on a radially inner edge with a chamfer so that the ridge of the diverter can be snapped into the array of tongues. These tongues form an axially outwardly directed shoulder that engages behind the ridge of the diverter. Thus the interconnection of the diverter and end plate makes it impossible for internal water pressure to deform the end plate. Furthermore the device, even if used with very hot water, will not deform and become useless.

In accordance with further invention features the end plate is formed at the axis with an axially throughgoing bore of a diameter larger than an outside diameter of the washer. The screw has a generally cylindrical head provided with an O-ring engaging an inner periphery of the end-plate bore. A cap set in the end-plate bore over the screw head covers this screw head and can have a decorative function. The washer is made of metal and the diverter, end plate, and core element are made of plastic.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
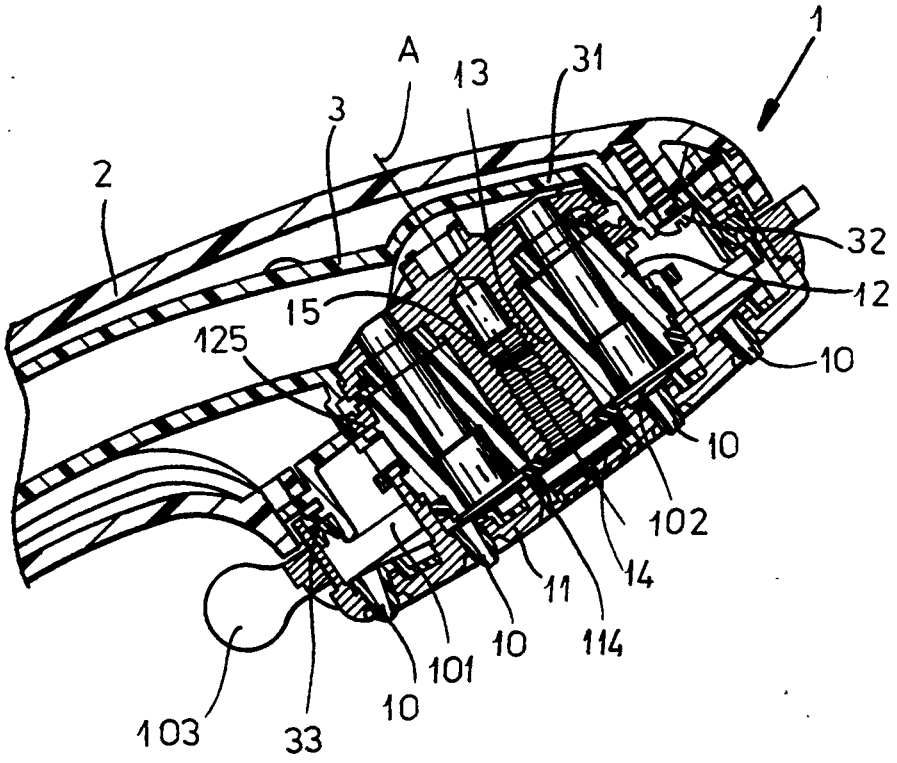
FIG. 1 is an axial and longitudinal section through the head end of a hand shower according to the invention.

As seen in FIG. 1 the shower according to this invention basically comprises a shower head 1 seated in a handle-forming housing 2 provided internally with a water-feed tube 3. The tube 3 is formed at its downstream or outer end as a seat 31 that is secured by screws 32 in the housing 2 and the shower head 1 fits in this seat 31 with seal rings 33 and 125 around it to prevent leakage. The shower head 1 is formed by a subassembly that is fixed, normally by fusing or gluing, in the seat 31, and that is shown in FIG. 2 and another subassembly that is secured by a screw 15 to the FIG. 2 subassembly and that is shown in FIG. 3.

Figure 2:
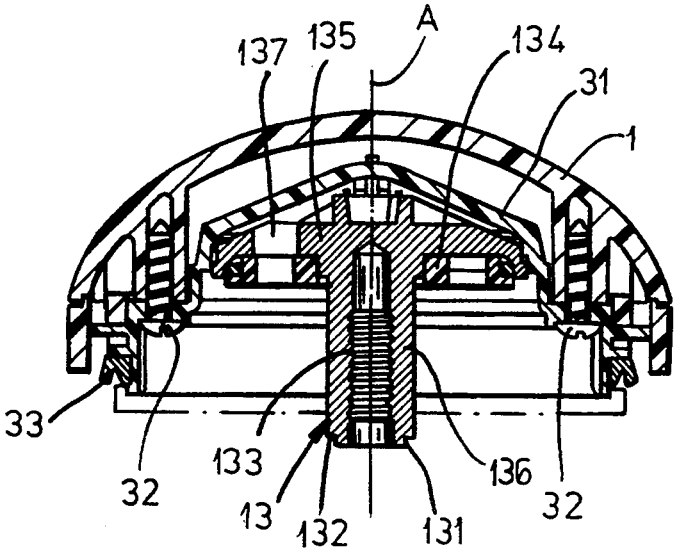
FIG. 2 is an axial section through the top subassembly of the shower head.

The subassembly of FIG. 2 comprises a core element 13 that is centered on an axis A and that basically comprises a disk 135 fixed in the seat 31 and a stem 136. At least one axially throughgoing hole 137 formed in the disk 135 allows water from the tube 3 to axially traverse the disk 135. An apertured seal disk 134 is seated in the disk 135 so that it cannot rotate therein as described in commonly owned patent application Ser. No. 07/883,839 filed 15 May 1992, now abandoned. The stem 136 has an outer end face 132 with a hexagonal boss 131 and is centrally formed with a threaded hole 133.

Figure 3:
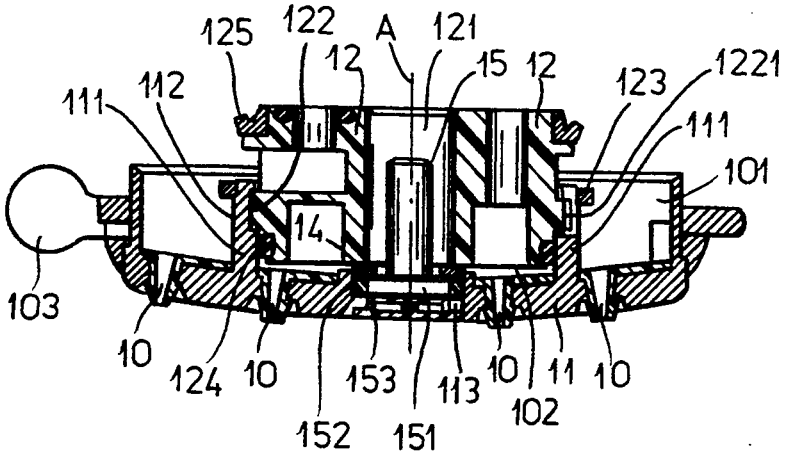
FIG. 3 is an axial section through the bottom subassembly of the shower head.

The subassembly of FIG. 3 basically comprises a perforated end plate or disk 11 and a water-diverter element 12 fixed thereto. The diverter 12 has a central hole 121 fitting over the stem 136 and a washer 14 with a central hexagonal hole complementary to the boss 131 is fitted thereon and axially inwardly engages the end of the diverter 12. The screw 15 in turn holds the washer 14 down to secure the diverter 12, and the plate 11 fixed to it, axially on the inner subassembly. The diverter 12 is formed with axially throughgoing passages as described in the above-identified copending patent application to feed water from the tube to respective chambers 101 and 102 respectively supplying inner and outer arrays of the nozzles 10.

Figure 4:
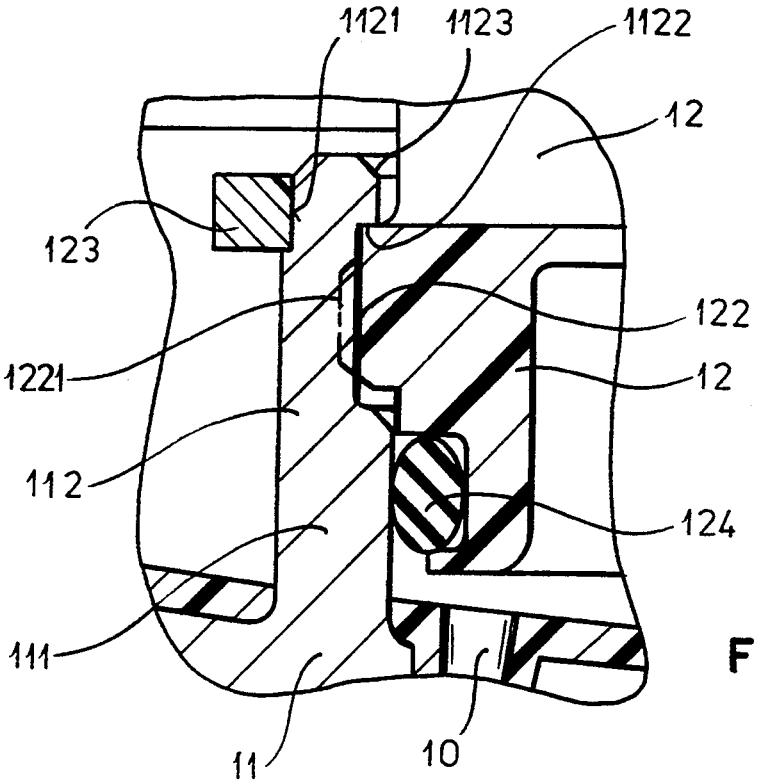
FIG. 4 is a large-scale view of a detail of FIG. 3.

As seen in better detail in FIG. 4 the plate 11 is formed with an axially rearwardly directed annular ridge 11 formed at its rear edge with radially deflectable snap tongues 112 in turn forming a forwardly directed retaining shoulder 1122 under which a radially outwardly projecting rim or ridge 122 of the diverter 12 engages. The inner edges of the snap tongues 112 are chamfered at 1123 to allow the two parts 11 an 12 to be snapped together. In addition the rim 122 is formed with at least one radially outwardly projecting boss 1221 that engages between adjacent tongues 112 to rotationally couple the parts 11 and 12 together. A metal snap ring 123 can be seated in a radially outwardly open seat 1121 in the rear ends of the tongues 112 to permanently secure these parts 11 and 12 together. An O-ring 124 is engaged radially between them to prevent leakage. A radially projecting arm 103 allows the subassembly 11, 12 to be moved between its positions.

The screw 15 has a cylindrical head formed with a radially outwardly open groove 151 in which is seated an O-ring 152 that rides on the inner periphery of a bore 114 in the end plate 11. A cap 153 seated in this bore 114 covers the bolt 15 and can have a decorative purpose.

Thus to mount the shower head 1 in the housing 1 first the core element 13 with the disk 134 is glued in place. Then the parts 11 and 12 are snapped together and secured to each other permanently by the ring 123 and they are fitted over the stem 136 with the seals 33 and 125 installed to prevent leakage between them. The washer 14 and screw 15 are installed as well as the cap 153 and the device is complete.

I claim:

1. An adjustable shower assembly comprising:

a housing provided with a water-supply tube defining a seat;

a core element fixed in the seat and having a stem extending from the seat along an axis and having an outer end formed with a noncircular boss generally centered on the axis;

a diverter formed with a central bore fitted over and axially traversed by the stem and provided with at least two throughgoing passages, the diverter being at least limitedly rotatable on the stem;

an end plate fixed on the diverter and formed with at least two sets of nozzles associated with the respective passages in respective angular positions of the diverter on the core element, and a central axially throughgoing bore of a diameter larger than an outside diameter of the washer;

means including a plurality of axially rearwardly projecting and radially deflectable snap tongues on the end plate and a radially outwardly projecting ridge on the diverter engaged under the tongues axially and formed with a radially outwardly projecting boss engaging between the tongues and rotationally fixing the end plate on the diverter;

a washer recessed in the bore of the end plate, having a central hole complementary to and interfitting with the boss of the stem, and bearing axially backward on the diverter, whereby the washer is nonrotatable on the housing and retains the diverter and end plate axially thereon; and a screw threaded axially into the stem and bearing axially backward on the washer to retain the diverter and end plate axially on the core element.

2. The adjustable shower assembly defined in claim 1 wherein the washer is made of metal and the diverter, end plate, and core element are made of plastic.

3. The adjustable shower assembly defined in claim 1, further comprising a snap ring engaged radially around the snap tongues and retaining same in place over the ridge of the diverter.

4. The adjustable shower assembly defined in claim 1 wherein each tongue is formed on a radially inner edge with a chamfer, whereby the ride of the diverter can be snapped into the array of tongues.

5. The adjustable shower assembly defined in claim 1 wherein the tongues forms an axially outwardly directed shoulder that engages behind the ridge of the diverter.

6. An adjustable shower assembly comprising:

a housing provided with a water-supply tube defining a seat;

a core element fixed in the seat and having a stem extending from the seat along an axis and having an outer end formed with a noncircular boss generally centered on the axis;

a diverter formed with a central bore fitted over the stem and provided with at least two throughgoing passages, the diverter being at least limitedly rotatable on the stem;

an end plate formed with at least two sets of nozzles associated with the respective passages in respective angular positions of the diverter on the core element;

means including formations axially and rotationally fixing the end plate on the diverter;

a washer having a central hole complementary to and interfitting with the boss of the stem and bearing axially backward on the diverter, the end plate being formed at the axis with an axially throughgoing bore of a diameter larger than an outside diameter of the washer; and a screw threaded axially into the stem and bearing axially backward on the washer to retain the diverter and end plate axially on the core element, the screw having a generally cylindrical head provided with an O-ring engaging an inner periphery of the end-plate bore.

7. The adjustable shower assembly defined in claim 6, further comprising a cover cap set in the end-plate bore over the screw head.

* * * * *